United States Patent [19]

Mahoney

[11] 4,090,904

[45] May 23, 1978

[54] LABELLING

[75] Inventor: Christopher I. Mahoney, Hingham, Mass.

[73] Assignee: Distribution Systems, Inc., Dorchester, Mass.

[21] Appl. No.: 675,254

[22] Filed: Apr. 8, 1976

[51] Int. Cl.[2] ..... B65C 3/12; B65C 9/20

[52] U.S. Cl. ..... 156/215; 156/291; 156/453; 156/570; 156/573; 156/DIG. 11; 156/DIG. 34

[58] Field of Search ..... 156/215, 217, 227, 291, 156/446, 447, 449, 451, 452, 453, 458, 475, 564, 565, 566, 570, 573, DIG. 9, DIG. 10, DIG. 34, DIG. 11, 252, 187, 195; 283/21; 40/306

[56] References Cited

U.S. PATENT DOCUMENTS

| | | | |
|---|---|---|---|
| 2,147,262 | 2/1939 | Mandel | 156/564 |
| 2,224,496 | 12/1940 | Wild et al. | 156/291 |
| 2,354,688 | 8/1944 | Kimball et al. | 156/453 |
| 2,517,395 | 8/1950 | Lewis | 156/453 |
| 2,684,775 | 7/1954 | Von Hofe | 156/215 |
| 2,868,403 | 1/1959 | Mattingly et al. | 156/453 |
| 3,017,311 | 1/1962 | Mattingly et al. | 156/453 |
| 3,110,554 | 12/1963 | Yazumi | 156/DIG. 9 |
| 3,179,548 | 4/1965 | Debray | 156/451 |
| 3,183,138 | 5/1965 | Mattingly et al. | 156/565 |
| 3,472,722 | 10/1969 | Hutchinson | 156/566 |
| 3,560,303 | 2/1971 | Nelson | 156/453 |
| 3,917,504 | 11/1975 | Neer | 156/453 |

*Primary Examiner*—William A. Powell
*Assistant Examiner*—William H. Thrower

[57] ABSTRACT

Disclosed are a labelling machine and method, a label for use therein, a container having the label secured thereto, and an adhesive applicator head especially adapted for use in the machine and the method. Adhesive is applied to the container in a pattern corresponding to a line of holes adjacent the leading edge of the label with a portion of the adhesive contacting the label adjacent the leading edge and a portion exposed through said holes to contact the portion of the label adjacent the trailing edge which is overlapped over said leading edge and said holes.

30 Claims, 10 Drawing Figures

LABELLING

This invention relates to labelling containers and especially to labelling with plastic, e.g., polyethylene, labels.

In labelling containers, such as plastic bottles, it is frequently desired to employ a label which extends completely around the container with the trailing portion overlapping the leading portion. Additionally, particularly where safety warnings, instructions and the like are printed on the label, it is preferred to use plastic, e.g., polyethylene, labels which are more durable than paper labels.

In the past, paper labels have been applied to bottles by applying adhesive on a line, minimizing the amount of adhesive employed, to the container, rolling the adhesive on the container against the leading edge portion of a label and applying adhesive to the trailing edge portion of the adhesive which overlaps and is secured to the leading edge portion. Although satisfactory for paper labels, difficulties have been encountered when plastic labels have been substituted due to difficulties in adhering the overlapping trailing edge portion to the underlying leading edge portion.

To overcome this problem, plastic labels have been applied to containers by first sealing the ends of the labels together, then stretching the label, slipping it over the container and releasing it to fit snugly on the container. In general this method of applying labels is much slower than prior methods of applying paper labels. Nor is the method without its own problems. Dimensional variations in container circumference or in label sealing sometimes leads to a label's being either too loose, permitting it to slip off the container or too small, resulting in rupture of the label.

Accordingly, it is a principal object of this invention to improve labelling of containers to permit the secure fastening of plastic labels to the containers with an improved rate of application. More particularly, it is an object of the invention to modify the method heretofore typically employed in applying paper labels to permit the use therein of plastic labels. It is a further object of this invention to provide such a method which is applicable to the use, as well, of paper labels and in which paper and plastic labels may be interchanged as desired. Other objects of this invention are to improve labelling machines for use with plastic labels, to provide modified labels adaptable for use in the method, to provide an adhesive applicator and a head therefor modified for use in the method, and to provide containers labelled in accordance with the improved labelling procedures.

In general, the invention features a label having a length exceeding the container circumference. Adjacent the label leading edge a plurality of spaced apertures, e.g., holes, are aligned with label material at the trailing edge thereof. Spindle receiving holes may also be provided adjacent the leading and trailing edges, such hole adjacent the leading edge positioned between said apertures and such hole adjacent the trailing edge aligned with label material at the leading edge. In a preferred embodiment the label material is polyethylene.

The method of applying the label to a container comprises applying adhesive to the container and contacting the leading edge of the label with the adhesive on the container and with a portion of the adhesive exposed through the apertures. The label is thereafter wrapped around the container and the trailing edge of the label is contacted with the adhesive exposed through the apertures to adhere the trailing edge directly to the container. Preferably, the adhesive is applied in spots smaller than and centered in the apertures and in the positions therebetween to avoid contacting the edges of the apertures which might result in lifting more than one label from a stack thereof. No adhesive is applied in the position of the lead spindle receiving hole in the label.

The resulting labelled container has the leading and trailing edges of the label adhered directly to the container by adhesive in the positions between the apertures at the label leading edge and exposed through the apertures at the trailing edge.

The labelling machine utilized in applying a label to a container comprises an adhesive applicator adapted to apply adhesive to the container, a label station for positioning the label to be picked up by the adhesive on the container and drive means for rotating the container. The adhesive applicator is adapted to apply adhesive in spots in line with and in positions corresponding to and between the label aperture positions at the label station, the spots being smaller than the label apertures. The applicator is spaced a predetermined distance from the aperture positions at the label station for positioning adhesive at and between the aperture positions as the container is rotated from the applicator to the label station. Spindles are preferably positioned at the label station to receive the leading and trailing edges of the label and the applicator is arranged to place adhesive at positions on either side of and out of line with the lead spindle. In a preferred embodiment the machine comprises means for rolling the container through the machine with the applicator and label station below the path thereof and with the applicator and aperture positions spaced apart a distance equal to the container circumference. A heater bar may be provided after the label station a distance from the aperture positions equal to twice the container circumference. The applicator heater bar and at least one spindle are preferably adjustable along the path traversed by the container to accept containers of different circumferences.

The applicator includes a head having first and second sets of adhesive exit passages. The first set is arranged in a pattern corresponding to the pattern of apertures in the label. The second set comprises passages between those of the first set. Preferably the exit passages open through separate raised platforms which limit the container contact area therewith.

Other objects, features and advantages of this invention will be apparent to those skilled in the art from the following detailed description of a preferred embodiment thereof taken together with the accompanying drawings, in which.

Figure 2:
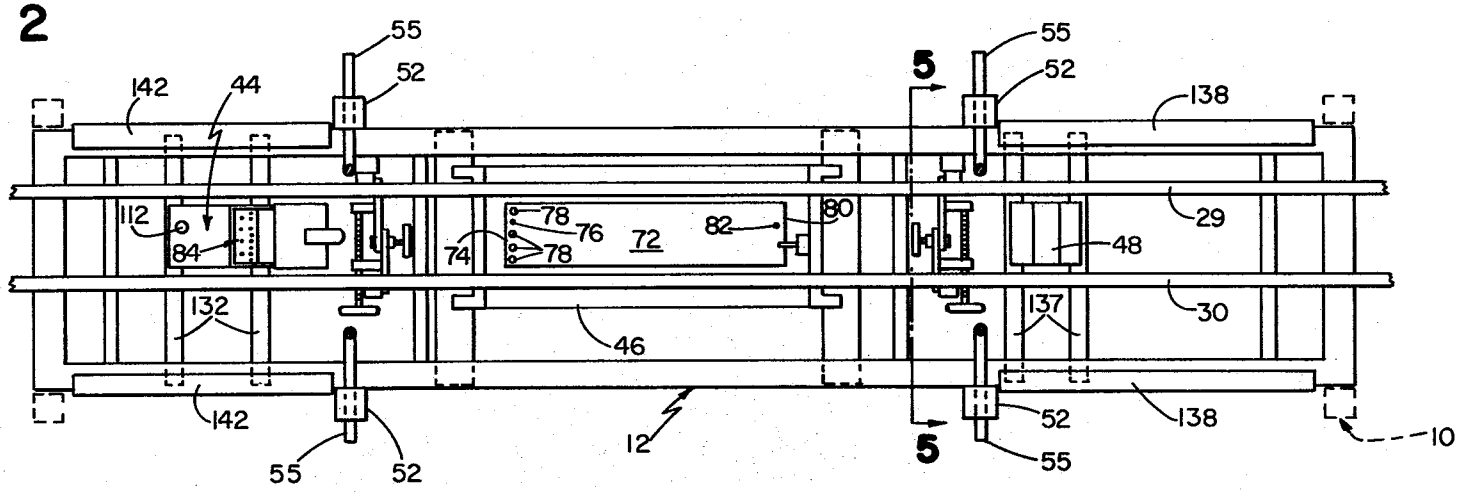
FIG. 2 is a plan view of the lower portion of the machine in FIG. 1 showing the operative elements thereof.
Figure 5:
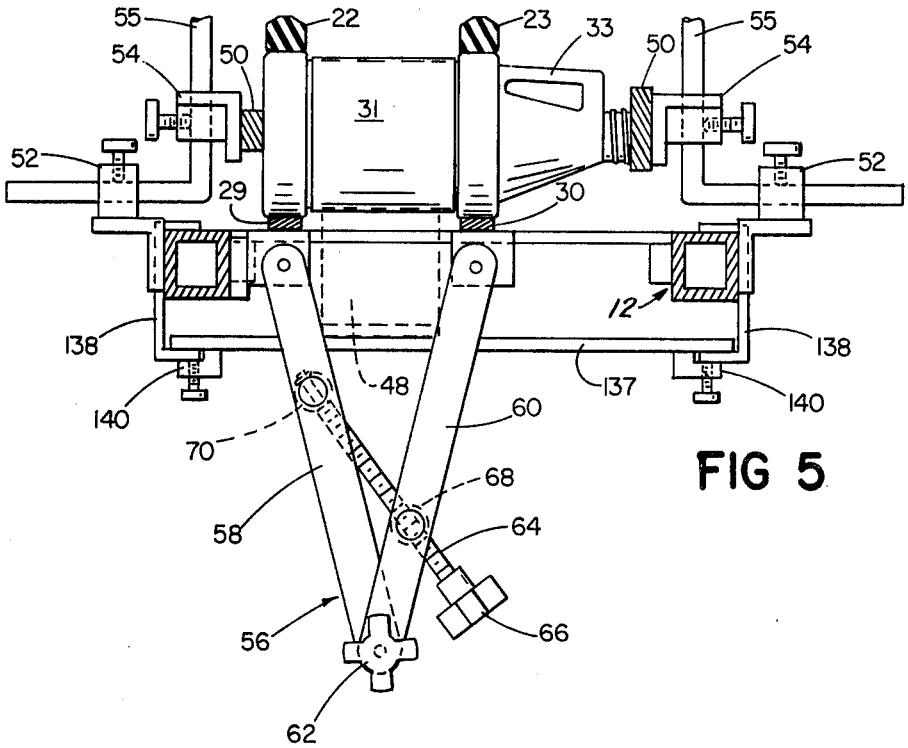
Figure 4:
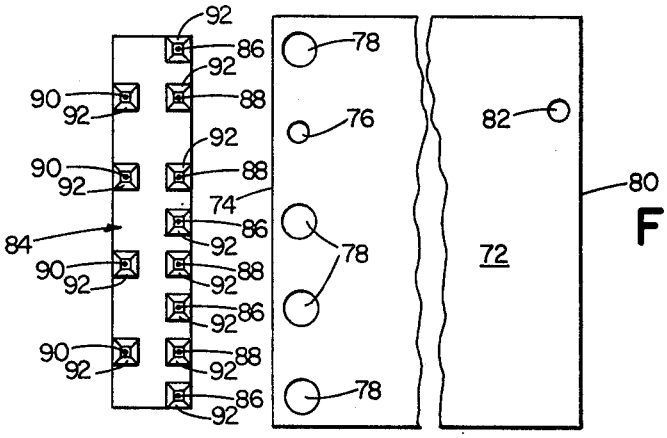

FIGS. 3A–E are enlarged schematic side elevations illustrating the container labelling sequence;

FIG. 4 is a plan view of an adhesive applicator head and a label according to the invention illustrating the inter-relationship thereof;

FIG. 5 is an enlarged view along the line 5—5 of FIG. 2; and

Figure 1:
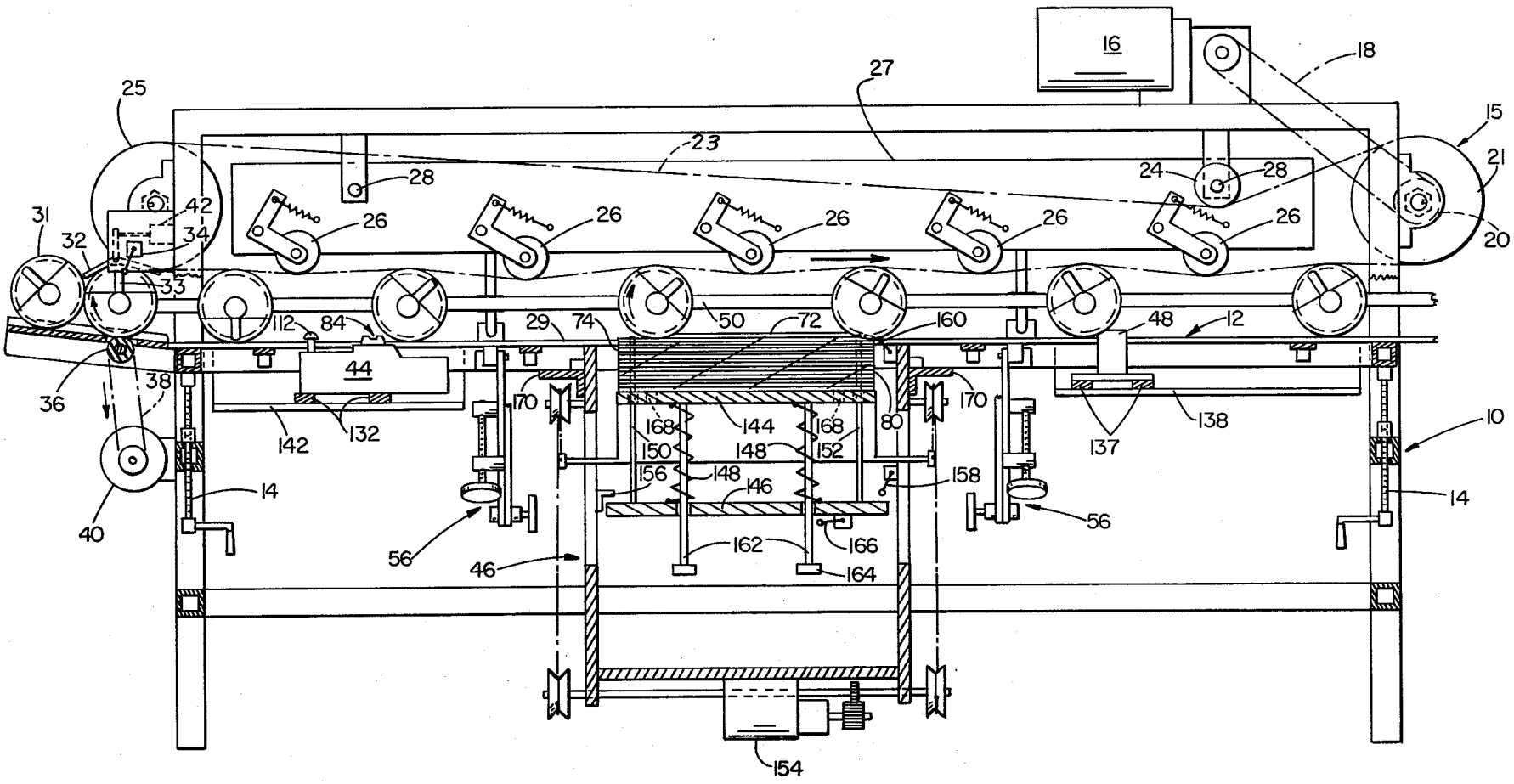
FIG. 1 is a partly schematic side elevation of a labelling machine according to the invention, with the front broken away for viewing purposes.
Figure 6:
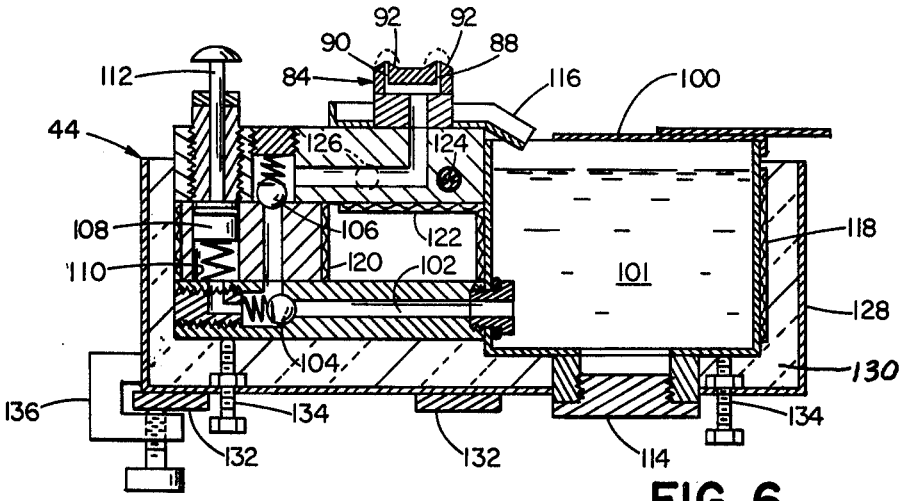

FIG. 6 is an enlarged sectional elevation of the adhesive applicator illustrated in FIGS. 1 and 2.

The labelling machine illustrated in FIG. 1, in its overall arrangement, is similar to machines heretofore employed for applying paper labels to containers.

The machine comprises a main frame 10 and a sub-frame 12 which is adjustable vertically by threaded members 14 to accommodate containers having different diameters. Drive means 15 are supported by frame 10 above the sub-frame 12 comprising, a motor 16 connected by a belt 18 to a sheave 20. The drive means 15 also comprises drive belts 22,23 (two are shown in FIG. 5) extending from drive wheels 21, connected to the shaft on which sheave 20 is mounted, under idler 24 around idler wheels 25 and back to drive wheels 21. A plurality of spring biased idlers 26, supported on frame members 27, bias belts 22,23 toward the sub-frame 12. Frame members 27 are supported on shafts 28.

The sub-frame 12 comprises a pair of tracks 29,30 facing upwardly toward drive belts 22 and along which containers 31, to be labelled, are rolled by engagement with drive belts 22,23. The machine entrance optionally includes a gate 32, a sensor 34, a roller 36 driven by belt 38 connected to motor 40, and a solenoid 42 operable to open gate 32 upon a signal from sensor 34. Positioned between tracks 29,30 after the machine entrance are an adhesive applicator 44 and a label station 46, to be described in greater detail hereafter. Following label station 46, a heater bar 48 is optionally provided having a polytetrafluoroethylene (Teflon) coating thereon. As best shown in FIG. 5, guide rails 50 are supported beside tracks 29,30 and are connected by brackets 52,54 to right angled rods 55 for horizontal and vertical adjustment to accommodate containers 31 of different diameters and axial dimensions. Also as best shown in FIG. 5, one track 30 is transversely adjustable by a toggle linkage connected between it and sub-frame 12. The toggle linkage 56 comprises two bars 58,60 respectively pivotally connected to sub-frame 12 and track 30 at one end and pivotally connected to each other at the other end. A handle 62 actuates a clamp at the pivotal connection of the bars to each other. A threaded rod 64, having an actuating handle 66 at one end extends through a threaded bushing 68 in one bar 60 and is rotatably secured in fixture 70 in bar 58, whereby rotation of handle 66 adjusts the track spacing. Belt 23 is also adjustable by movement of wheels 21,26 on their shafts and by movement of frame members 27 on supporting shafts 28 to position supporting idlers 26.

Turning now to particular features of the present invention, the labels 72, best shown in FIG. 4, which are positioned at label station 46 each comprise a web of label material, which may be organic plastic material such as polyethylene. The leading edge 74 of the label, i.e., the edge first contacted by a container 31 as it moves through the labelling machine, is provided with a spindle receiving aperture or hole 76 therein and with a plurality of additional spaced apart apertures or holes 78 adjacent and preferably set in a small distance from the leading edge 74, at least one hole 78 being positioned on each side of spindle hole 76. The label length between the leading and trailing edges 74,80 exceeds the circumference of the container 31 to be labelled by an amount sufficient to permit the web material adjacent the trailing edge 80 to overlap the leading edge 74 and holes 78. Web material is provided adjacent trailing edge 80 aligned with holes 78 for overlapping and covering the holes 78. A spindle hole 82 is provided adjacent the trailing edge 80 aligned with web material adjacent the leading edge.

The adhesive applicator 44 includes an applicator head 84 for applying a hot melt adhesive to a container in a pattern corresponding to the predetermined hole pattern at the label leading edge. As illustrated in FIG. 4, the applicator head comprises a first plurality of adhesive exit passages 86 in a pattern corresponding to the pattern of holes 78 in label leading edge 74. Passages 86 are aligned with the position of holes 78 of the labels 72 in the labelling machine and are spaced therefrom a distance equal to the circumference of container 31. Between passages 86 are positioned a second set of adhesive passages 88 aligned with the position web material adjacent the label leading edge 74. No adhesive passage is provided in head 84 in alignment with the position of spindle hole 76. Optionally, a third set of adhesive exit passages 90 may be provided ahead of passages 86,88 spaced more than the container circumference from the label leading edge 74. Passages 86,88,90 are located in separately raised platforms 92 of head 84, and having a small area, e.g., about $\frac{1}{8}$ inch square, to minimize the area of contact between container 31 and the adhesive exiting therefrom, thereby to provide discrete spots of adhesive on the container 31 which will avoid contact with the edges of the label 72 around holes 78 which have a diameter, typically, of about $\frac{3}{8}$ inch.

The adhesive applicator 44 is shown in greater detail in FIG. 6. As illustrated, the applicator 44 comprises a storage chamber 100 for the adhesive 101, head 84 and a pump passage 102 extending therebetween. A pair of spring biased ball valves 104, 106 are positioned in passage 102 between chamber 100 and head 84. Spring biased pump piston 108 is slidably positioned in cylinder 110 which communicates with passage 102 between valves 104,106. Piston rod 112 extends above the applicator for actuating piston 108 by depression downwardly to pump adhesive through head 84 and exit passages 86,88,90. A drain plug 114 is located at the base of chamber 100 and a spill tray 116 is positioned below head 84 to return excess adhesive flowing from head 84 to chamber 100.

Separate heaters are provided in applicator 44 to maintain the hot melt adhesive 101 at progressively higher temperatures from chamber 100 to head 84. A flexible silicone rubber heater 118 is wrapped around chamber 100 to maintain adhesive therein at a temperature of about 270°-300° F. to hold the adhesive in a melted condition without the deleterious effects of high heat. Another flexible silicone rubber heater 120 is wrapped around the pump portion of passage 102 to raise the temperature of the adhesive thereat to about 330° F. Another flexible silicone rubber heater 122 and a cartridge heater 124 are located at the portion of passage 102 adjacent head 84 to raise the temperature of adhesive thereat to a suitable working temperature, normally in the range of 340°-360° F., for hot melt adhesives. A thermostat indicated at 126 controls the adhesive working temperature in passage 102 adjacent head 84.

The applicator 44 is supported in a tray 128 having a lining of insulation 130 to minimize heat losses from applicator 44. The applicator 44 in tray 128 is supported on cross-bars 132 in the labelling machine and is vertically adjustable by threaded members 134 extending through tray 128 to applicator 44. A clamp 136 fastens tray 128 to cross-bars 132 and permits adjustment of the applicator 44 transversely of the machine depending upon the container 31 configuration. Heater 48 is similarly supported on cross-bars 137 and is similarly adjustable transversely (not shown). Cross-bars 137 for heater 48, as shown in FIG. 5, are longitudinally adjustable along rails 138 and are secured by clamps 140 to rails 138 for adjustment to accommodate different container circumferences. Applicator support cross-bars 132 are similarly supported on rails 142, see FIG. 1, and are similarly adjustable (not shown).

Label station 46, best shown in FIG. 1, comprises a platform 144 to support a stack of labels 72. A lower platform 146 is connected to label platform 144 by tension springs 148 and supports spindles 150,152 which extend through label platform 144. Labels 72 are placed on label platform 144 with spindles 150,152 extending through spindle receiving holes 76,82 adjacent the leading and trailing edges of labels 72. Label platform 144 is shown, schematically, connected to motor 154 which can be actuated by controls (not shown) to raise and lower the platform 144. As motor 154 is activated to raise the platform, the motor operates at a high speed until lower platform 146 reaches stop 156 when switch 158 is contacted to cause motor 154 to operate at slow speed. Stop 156 fixes the maximum height of spindles 150,152 at the height of tracks 29,30. Switch 160 detects the height of labels 72 and stops motor 154 when the labels reach the height of the container surface to be contacted by the labels 31. As labels are removed from the stack, switch 160 causes motor 154 to operate to further raise the label stack. Guide rods 162 extending from label platform 144 through lower platform 146 move upwardly with label platform 144 until the stack of labels is exhausted, at which point head 164 on one guide rod 162 contacts switch 166 which reverses motor 154 to lower label platform 144 to receive additional labels. As platform 144 is lowered, tension springs 148 extend spindles 150,152 through label platform 144. Spindles 150,152 are adjustable, supported in one of a plurality of threaded holes (not shown) in lower platform 146 and extending through one of corresponding holes 168 to accommodate labels of different lengths. The label station 46 is transversely adjustable along supporting rails 170 for adjustment to accommodate containers of different configurations.

Figure 3A:
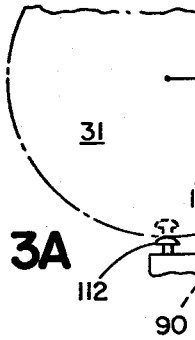
Figure 3B:
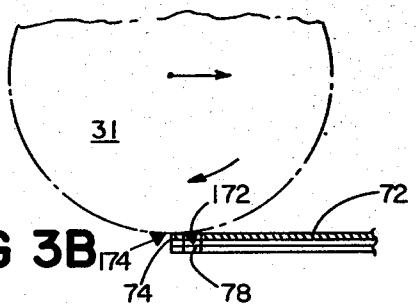
Figure 3C:
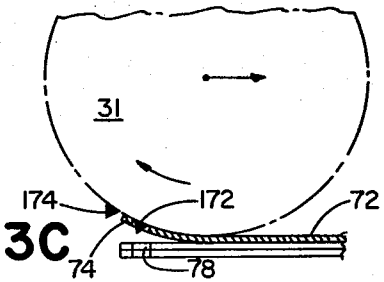
Figure 3D:
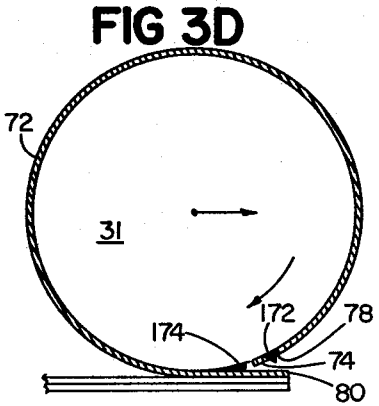
Figure 3E:
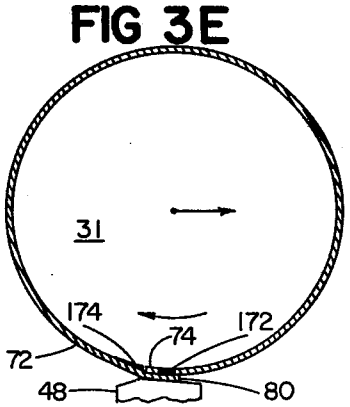

The labelling method utilized in the operation of the machine is broadly illustrated in FIGS. 3A–E. In general, the container 31 is rotated through the machine to the label applicator 44, shown in FIG. 3, where it depresses piston rod 112 forcing adhesive 172,174 through the exit passages 86,88 (not shown in FIG. 3A), 90. As the container rotates to head 84 it contacts and picks up the adhesive thereat in a pattern of small discrete spots. Thereafter the container rotates one revolution to the position of the label leading edge 74, illustrated in FIG. 3B. The adhesive 174 on container 31 from optional head passages 90 leads and avoids contact with the label leading edge 74. Label holes 78, adjacent leading edge 74, are aligned with adhesive 172 from head passages 86 centering the adhesive 172 in holes 78, without contacting the label therearound, and exposing the adhesive 174 through holes 78. Simultaneously, adhesive from head passages 88, shown in FIG. 4, aligned with label web material between holes 78, contacts the label 72 and as the container 31 continues to rotate the label 72 is thereby picked up, illustrated in FIG. 3C and wrapped around the container 31, as shown in FIG. 3D. As shown in FIG. 3D, as container 31 is rotated one revolution from label leading edge, adhesive spots 174 contact the trailing portion of label 72 ahead of the leading edge 74 and the portion of the label adjacent the trailing edge 80 overlaps the leading edge 74 and holes 78 contacting adhesive spots 172 centered in holes 78. Thus the overlapped portion of the label is adhered directly to the surface of container 31. As the container rotates one additional revolution, illustrated at FIG. 3E, the label optionally contacts heater bar 48 to further activate the adhesive and thereby to assure good adherence of the label to the container.

In FIG. 1, the machine is shown, somewhat schematically, applying labels to plastic bottles 31 having handles 33 thereon. In the operation of the machine, the sub-frame 12 is first adjusted vertically by members 14 with reference to drive belts 22,23 to accommodate the particular bottle diameter. Track 30 is adjusted by linkage 56 and belt 23 is adjusted by movement of wheels 21,26 and frame member 27, as necessary to accommodate the particular bottle axial height. Adjustments as necessary are also made in the height and spacing of guide rails 50. Transverse adjustments are made as necessary to applicator 44, label station 46 and heater bar 48. Applicator 44 is also adjusted longitudinally along the bottle path to space head exit passages 86,88 one revolution of bottle 31, i.e., a distance equal to the bottle circumference, from the position of label leading edge holes 78 at label station 46. Similar adjustment of heater bar 48 is made to space it two revolutions from the position of label holes 78 at station 46. A stack of labels is placed on platform 144 in its lowered position. Motor 154 is then activated at high speed to raise platform 144. When lower platform 146 strikes stop 156 and switch 158 the maximum spindle height is fixed and motor 154 operates at slow speed until the stack of labels is detected by switch 160 stopping motor 154.

Drive belts 22,23 are driven by motor 16 to engage and rotate bottles 31 along tracks 29,30. Motor 40 drives roller 36 at the machine entrance to rotate the bottles 31 until handles 33 are detected by sensor switch 34 which then activates solenoid 42 to open gate 32 to admit the bottle to the machine in a predetermined orientation. The bottles are then rolled along the tracks 29,30 encountering applicator 44, label station 46 and heater bar 48, as previously described.

At the exit of the labelling machine the bottles 31 are discharged with the labels 72 wrapped around the circumference thereof. The trailing portion of the label is secured directly to the container by adhesive exposed through label holes 78 thus securing the overlapped portion of the label adjacent the trailing edge 80.

Advantageously, polyethylene labels are securely fastened to the containers when applied in this manner. Additionally, the rate of labelling is significantly increased relative to labelling methods typically employed with plastic labels. As another advantage, labels of paper with the hole pattern disclosed may be interchanged for plastic labels in the method and machine when desired thus enabling use of the machine for multiple purposes.

Other embodiments of this invention will be apparent to those skilled in the art which are within the scope of the following claims.

What is claimed is:

1. A labelling machine for applying a label to a container, comprising drive means for rotating said container, an adhesive applicator for applying adhesive to said container as it is rotated and a label station for positioning labels to be applied to said container as said container is rotated by said drive means, characterized in that said labelling machine comprises only a single adhesive applicator, said applicator spaced a predetermined distance ahead of said labelling station, and further characterized in that said applicator comprises sets of applicator means adapted to apply discrete spots of adhesive to said container, one set of applicator means aligned with the predetermined positions at said label station of apertures in the leading edge of said labels, said one set of applicator means adapted to apply said adhesive spots to said container smaller than the predetermined size of said apertures and aligned with said predetermined positions of said apertures, and another set of applicator means aligned with the predetermined positions at said label station of web material adjacent said apertures at the leading edge of said labels, said other set of applicator means adapted to apply said adhesive spots to said container aligned with said predetermined positions of said web material, said machine thereby adapted to apply spots of adhesive to said container for contact with the label leading edge and for exposure through said apertures to contact the label trailing edge overlapping said leading edge.

2. A labelling machine for applying a label to a container comprising, drive means for rotating said container, an adhesive applicator for applying adhesive to said container as it is rotated, and a label station for positioning a label to be picked-up by adhesive on said container as said container is rotated after application of adhesive thereto, characterized in that:

said adhesive applicator comprises means, including sets of adhesive exit passages, adapted to apply sets of discrete spots of adhesive to said container, one set of said exit passages adapted to apply a first set of said adhesive spots to said container smaller than the predetermined size of apertures in the leading edge of labels to be applied to said container, each said passage of said one set aligned in the direction of container rotation with the predetermined center position at said label station of one of said label apertures and said passages of said one set spaced a predetermined distance from said predetermined aperture positions for locating said first set of spots at said predetermined center positions upon rotation of said container from said adhesive applicator to said labelling station, another set of said exit passages adapted to apply a second set of said adhesive spots to said container, each said passage of said other set aligned in the direction of container rotation with the predetermined position at said label station of label web material spaced from and adjacent said predetermined position of said label apertures and said passages of said other set spaced said predetermined distance from said web positions for locating said second set of spots at said predetermined web position upon rotation of said container from said adhesive applicator to said labeling station; whereby a portion of said adhesive is adapted to contact a label as a container rotates from said applicator to said label station and a portion of said adhesive is adapted for exposure through label apertures to contact a trailing portion of said label overlapping said label leading edge as said container is rotated to wrap said label therearound, thereby adhering said overlapping trailing portion directly to said container.

3. The machine claimed in claim 2 further characterized in comprising spindles at said label station adapted to receive and position labels at said label station, one spindle at the position of said label leading edge and the other at the position of said label trailing edge, said adhesive applicator adapted to apply adhesive to said container in line with positions on each side of said one spindle and said spindles positioned transversely out of line with said aperture positions.

4. The machine claimed in claim 2 comprising a frame defining a path along which said container is moved and drive means for moving said container along said path and for rotating said container at a circumferential speed equal to the speed of movement along said path, further characterized in that: said applicator and said label station are positioned along said path on the same side thereof for rolling contact of said container with said applicator and with labels at said label station, with said applicator ahead of said station and with said applicator spaced from the predetermined label aperture position at said label station a distance equal to the circumference of said container.

5. The machine claimed in claim 4 in which said applicator and said label station are positioned below said path further characterized in that spindles are positioned at said label station directed upwardly to receive and position labels at said label station, one spindle at the predetermined position of said label leading edge and the other at the predetermined position of said label trailing edge, said adhesive applicator adapted to apply adhesive to said container in line with predetermined positions on each side of said one spindle and out of line with said one spindle and said other spindle positioned transversely out of line with said aperture positions.

6. The machine claimed in claim 5 further characterized in comprising a heater bar positioned along said path sequentially after said label station and spaced from said predetermined aperture position a distance equal to twice the circumference of said container.

7. The machine claimed in claim 6 in which said applicator, said heater bar and at least one of said spindles are adjustable along said path for adjustment to accommodate containers of different circumferences.

8. The machine claimed in claim 5 in combination with a stack of labels at said label station having spindle receiving holes adjacent the leading and trailing edges thereof with said spindles extending therethrough and having a plurality of apertures comprising adhesive exposure holes adjacent said leading edge, one on each side of the spindle receiving holes adjacent said leading edge, said adhesive exposure holes aligned with label material adjacent the trailing edge thereof and aligned at said label station with said adhesive applicator and the positions thereof at which said applicator is adapted to apply adhesive spots to said container centered in said apertures, said labels having a length greater than the circumference of said container by an amount to permit overlapping said adhesive exposure holes with the portion of said label adjacent said trailing edge with said label wrapped around said container.

9. The method of applying a label to a container comprising the steps of: rotating said container; applying adhesive to said container as it rotates; providing said label adjacent the leading edge thereof with a plurality of spaced apart apertures therein; contacting said label adjacent said leading edge with a portion of said adhesive on said container as said container continues to rotate and simultaneously exposing a portion of said adhesive through said apertures; continuing to rotate said container wrapping said label thereabout; and overlapping the portion of said label adjacent said trailing edge thereof over said apertures contacting said overlapped portion of said label with adhesive exposed through said apertures; whereby said adhesive secures said label directly to said container adjacent said leading and overlapped trailing edges.

10. The method claimed in claim 9 further comprising applying said adhesive to said container in discrete spots, centering one set of spots in a pattern corresponding to the pattern formed by said label apertures and placing spots of a second set between said spots of said one set, and contacting said label with said second set of spots while centering said spots of said one set in said apertures spaced from said label around said apertures.

11. The method claimed in claim 10 in which said apertures comprise holes comprising applying said adhesive spots of said one set to said container in a size smaller than the smallest dimension of said holes.

12. The method claimed in claim 11 comprising applying said adhesive spots in the pattern of said label holes except in the position of a hole reserved for receiving a spindle therein.

13. The method claimed in claim 12 in which said label is organic plastic material.

14. The method claimed in claim 13 in which said label is polyethylene.

15. The method of applying a label to a container comprising the steps of:

applying adhesive to said container;

providing said label with a plurality of apertures adjacent the leading edge thereof;

contacting said label adjacent said leading edge with a portion of said adhesive on said container and simultaneously exposing a portion of said adhesive through said apertures;

wrapping said label around said container, overlapping the portion of said label adjacent the trailing edge thereof over said leading edge and said apertures, and contacting said overlapped portion of said label with adhesive exposed through said apertures.

16. The method claimed in claim 15 including providing a label of organic plastic material.

17. The method claimed in claim 16 including providing a label of polyethylene.

18. A label for attachment about the circumference of a container comprising a web of label material defining a leading and a trailing edge and defining a label length between said edges exceeding the circumference of said container permitting overlapping the portion of said label adjacent said trailing edge over the portion of said label adjacent the leading edge, characterized in that: said label comprises a plurality of spaced apart apertures interrupting said web adjacent said leading edge and web material in the overlapping portion adjacent said trailing edge aligned with said apertures; whereby adhesive applied to said container may be exposed through said apertures to contact and secure directly to said container said overlapping portion adjacent said trailing edge.

19. The label claimed in claim 18 further including spindle receiving holes adjacent said leading and trailing edges.

20. The label claimed in claim 18 in which said apertures comprise adhesive exposure holes adjacent said leading edge.

21. The label claimed in claim 20 further including spindle receiving holes adjacent said leading and trailing edges, said leading edge spindle receiving hole positioned between a pair of adhesive exposure holes.

22. The label claimed in claim 21 in which said trailing edge spindle receiving hole is aligned with web material adjacent said leading edge.

23. The label claimed in claim 22 in which said label material is organic plastic.

24. The label claimed in claim 23 in which said label material is polyethylene.

25. A container having a label of organic plastic material, comprising a web, extending around the circumference thereof and adhesively secured thereto with one end of said label overlapping the other end of said label characterized in that: said label other end comprises the leading edge of said label and adjacent said leading edge comprises a plurality of spaced apart apertures interrupting said label web; said label one end comprises a trailing edge of said label, said web adjacent said trailing edge extending across said apertures; and adhesive is positioned on said container adjacent said leading edge contacting and securing said web to said container adjacent said leading edge and a portion of said adhesive is positioned in said holes contacting through said holes and securing said web adjacent said trailing edge directly to said container.

26. The container claimed in claim 25 in which one hole is located in said label adjacent the leading edge having no adhesive therein and a second hole is located adjacent the trailing edge of said label spaced away from said apertures.

27. The container claimed in claim 26 in which said apertures comprise holes adjacent said label leading edge.

28. The container claimed in claim 25 in which said label comprises polyethylene.

29. An adhesive applicator head for the application of adhesive to a container for securing a label thereto, which label has a predetermined pattern of holes therein adjacent the leading edge thereof first contacted by said label, said applicator head comprising: a first plurality of exit passages in a pattern corresponding to the pattern of said holes and adapted to produce spots of adhesive smaller than the predetermined size of said holes; and a second plurality of exit passages positioned between said first passages, whereby adhesive dispensed through said first passages on said container may be aligned with said label holes for contacting and securing an overlapped portion of said label directly to said container and adhesive dispensed through said second passages on said container is adapted to contact and secure said label between said holes.

30. The adhesive applicator head claimed in claim 29 in which said exit passages open through separate raised platforms on said head to limit the contact area of said container therewith.

* * * * *